US007626500B2

(12) United States Patent
Belden, Jr. et al.

(10) Patent No.: US 7,626,500 B2
(45) Date of Patent: Dec. 1, 2009

(54) SECURITY DISPLAY WITH CENTRAL CONTROL SYSTEM

(75) Inventors: Dennis D. Belden, Jr., Canton, OH (US); Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 206 days.

(21) Appl. No.: 11/969,961

(22) Filed: Jan. 7, 2008

(65) Prior Publication Data

US 2008/0168806 A1 Jul. 17, 2008

Related U.S. Application Data

(60) Provisional application No. 60/880,131, filed on Jan. 12, 2007.

(51) Int. Cl.
*G08B 13/14* (2006.01)

(52) U.S. Cl. ..... 340/568.1; 340/568.2; 340/568.3; 340/568.8; 340/571; 439/505; 439/917

(58) Field of Classification Search ..... 340/568.1, 340/568.2, 568.3, 568.4, 568.8, 686.1, 686.6, 340/571; 439/501, 505, 527, 917
See application file for complete search history.

(56) References Cited

U.S. PATENT DOCUMENTS

| | | | |
|---|---|---|---|
| 3,710,224 | A | 1/1973 | Daniels |
| 4,598,827 | A | 7/1986 | Keifer |
| 4,618,857 | A | 10/1986 | Dubois et al. |
| 4,620,182 | A | 10/1986 | Keifer |
| 4,746,909 | A | 5/1988 | Israel et al. |
| 4,962,369 | A | 10/1990 | Close |
| 5,341,124 | A | 8/1994 | Leyden et al. |
| 5,517,175 | A | 5/1996 | Brown et al. |
| 5,561,417 | A | 10/1996 | Rothbaum et al. |
| 5,838,225 | A | 11/1998 | Todd |
| 6,104,289 | A | 8/2000 | Rand |
| 6,150,940 | A | 11/2000 | Chapman et al. |
| 6,380,855 | B1 | 4/2002 | Ott |
| 6,386,906 | B1 | 5/2002 | Burke |
| 6,476,717 | B1 | 11/2002 | Gross et al. |
| 6,509,659 | B1 | 1/2003 | Carroll et al. |
| 6,570,502 | B2 | 5/2003 | Matsuo |
| 6,690,277 | B1 | 2/2004 | Hansen et al. |
| 6,756,900 | B2 | 6/2004 | Leyden et al. |
| 6,761,579 | B2 | 7/2004 | Fort et al. |
| 6,799,994 | B2 | 10/2004 | Burke |
| 6,836,214 | B2 | 12/2004 | Choi |
| 6,896,543 | B2 | 5/2005 | Fort et al. |
| 6,946,961 | B2 * | 9/2005 | Frederiksen et al. ..... 340/568.2 |

(Continued)

*Primary Examiner*—Davetta W Goins
(74) *Attorney, Agent, or Firm*—Christopher C. Dremann, P.C.

(57) ABSTRACT

A security system for protecting a plurality of items of merchandise on display in a retail environment. Each of the items is connected to a sensor which is removably mounted in a display module and connected thereto by a power cord. A single alarm module located in an inaccessible location is connected to each of the display modules by another power cord. A power cord connects each of the display modules to a source of electricity for supplying electric power to the sensor through the display module and then to the displayed item for maintaining the charge on a battery of the displayed item. The alarm unit contains an internal power source for controlling the alarm circuitry. A plunger switch and LED may be contained in the sensor.

16 Claims, 4 Drawing Sheets

U.S. PATENT DOCUMENTS 6,956,479 B2 10/2005 Kelsch et al.
7,015,596 B2 3/2006 Pail
7,209,038 B1 * 4/2007 Deconinck et al. ..... 340/568.8

* cited by examiner

SECURITY DISPLAY WITH CENTRAL CONTROL SYSTEM

CROSS REFERENCE TO RELATED APPLICATIONS

This application claims priority from U.S. Provisional Patent Application Ser. No. 60/880,131 filed Jan. 12, 2007; the disclosure of which is incorporated herein by reference.

BACKGROUND OF THE INVENTION

1. Technical Field

The invention relates to security systems for the display of items of merchandise as in a retail establishment. More particularly, the invention relates to a security system which supplies power to a plurality of displayed products all of which are connected to a central alarm module and connected in a secured condition to individual sensors and associated display modules. Furthermore, the security system provides for charging the internal batteries of the displayed products or supplying electricity for controlling other features of the individually displayed products.

2. Background Information

Retail stores have a difficult time protecting items of merchandise which the potential customer wishes to visually inspect and handle prior to making the decision to purchase the items. Often such items have been keep in a glass case under lock and key which does not allow a customer to handle the item without assistance of store personnel. In addition, while such items may be secured to a foundation or base by a cable or the like to enable the potential customer to handle and inspect the product before purchase, this does not necessarily prevent the theft of the item by cutting of the cable or detaching the product from the cable.

Therefore, various security systems have been developed which include a display module secured to a support surface such as a display shelf, which supports a sensor that is attached to an item of merchandise and which is mechanically and electrically connected by a lanyard to the display module. This enables a potential customer to pick up and handle the item such as a cell phone, camera, mini DVDs, MP3 players and the like, prior to purchasing the item, while the item is maintained connected to the display module. These display modules and sensors are provided with switches which will actuate an alarm contained in the display module if the item is removed from the sensor, or the module removed from its support surface, or if a connecting lanyard is severed or tampered with in an unauthorized manner. These security systems utilizing such display modules and sensors have proven satisfactory for many retail security applications.

Heretofore, these security systems require a single alarm module either located internally on the display stand or at a remote location and connected to the sensor which is attached to the product. This requires additional space and equipment to provide protection for each of the displayed products.

However, another problem has developed in the display of various items of merchandise which require a source of power, usually provided by an internal battery, such as digital cameras, music players, cell phones, mini DVD players, MP3 players etc. After the product has been displayed for a period of time, the battery will loose charge resulting in the product being inoperable requiring constant recharging of the battery by store personnel.

Therefore, the need exists for a security system, and in particular one that has a plurality of display modules, each of which supports a security sensor which is attached to an item of merchandise, each of which is operationally connected to a central alarm system to eliminate multiple components, and which will enable power to be supplied to each of the protected items on display to maintain a charge on the internal batteries of the items or supply electric power to other components of the items of merchandise.

BRIEF SUMMARY OF THE INVENTION

One aspect of the present invention is to provide a security system which includes a plurality of display modules, each of which supports a sensor that is attached to an item of merchandise, wherein each of the display modules and sensors are connected to a central alarm system which sounds an alarm should a thief attempt to remove any of the items of merchandise from the attached sensors or any of the display modules from the display location.

Another feature of the present invention is to provide a security system in which each of the display modules is attached to electrical conductors connected to a remote source of electricity so that electric power can be provided through the display module to the associated sensor for supplying electric power to the item of merchandise attached to the sensor for maintaining the charge on an internal battery or for controlling other features of the protected item of merchandise requiring electric power.

A further feature of the present invention is to provide a security system in which each of the sensors have a visual indicator such as an LED, indicating to a clerk or potential thief that an alarm system is activated and that the displayed item of merchandise is protected by the security system, and a plunger switch that is activated when the sensor is attached to the displayed product by depressing a plunger to operationally connect the security switch to the central alarm system.

Another aspect of the present invention is to enable the display module of the security system to be electrically and mechanically connected to the sensor by a power cord which extends between the sensor and a power output port mounted in the display module for supplying electric power through the sensor to the protected items of merchandise.

A further feature of the present invention is that a power cord which connects the display module to the sensor contains a plurality of electrical conductors which are connected to the output port on the display module and subsequently to the central alarm module with an easily attached removable connector to enable various sensors to be easily mounted on the display module, yet which will sound the alarm if the power cord is removed from the display module or the conductors thereof severed by a potential thief, and in which the power cord preferably contains six electrical conductors, two of which power a safety plunger switch mounted within the sensor with two other of the conductors powering a visual indicator (LED) provided in the sensor, with the other two conductors being connected to a power output jack of the sensor from which electric power is supplied to the item of merchandise attached to the sensor.

Another feature of the invention is to provide the display module and sensor with a pair of magnets providing self-orientation of the displayed item when returned to the display module.

Still another feature of the present invention is to individually connect each of the display modules to a remote source of power which is operationally connected to the power output port on the display module for subsequent supplying of electricity to the sensor and to a displayed product.

A further feature of the invention is to provide the central alarm module with an audible alarm which will sound if any of the sensors are removed from the product, or if the lanyard extending between the display module and sensor is severed or removed.

These objectives and features are obtained by the security system of the present invention for displaying and protecting a displayed product, the general nature of which may be stated as comprising: a central alarm module; a plurality of individual display modules mounted on one or more supports; a sensor removably mounted on each of the display modules; a first power cord electrically and mechanically connecting the sensor to the display module; a second power cord extending between each of the display modules and the alarm module; a source of electric power; a third power cord extending from the source of electric power to each of the display modules providing an electrical conductive path from the source of electric power through the display module and through the first power cord to each of the sensors; and a fourth power cord electrically connected to the source of electric power and to the central alarm module at the sensor, and extending from the sensor for electrically and mechanically connecting the item of merchandise to the sensor to supply electric power to said item of merchandise.

DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
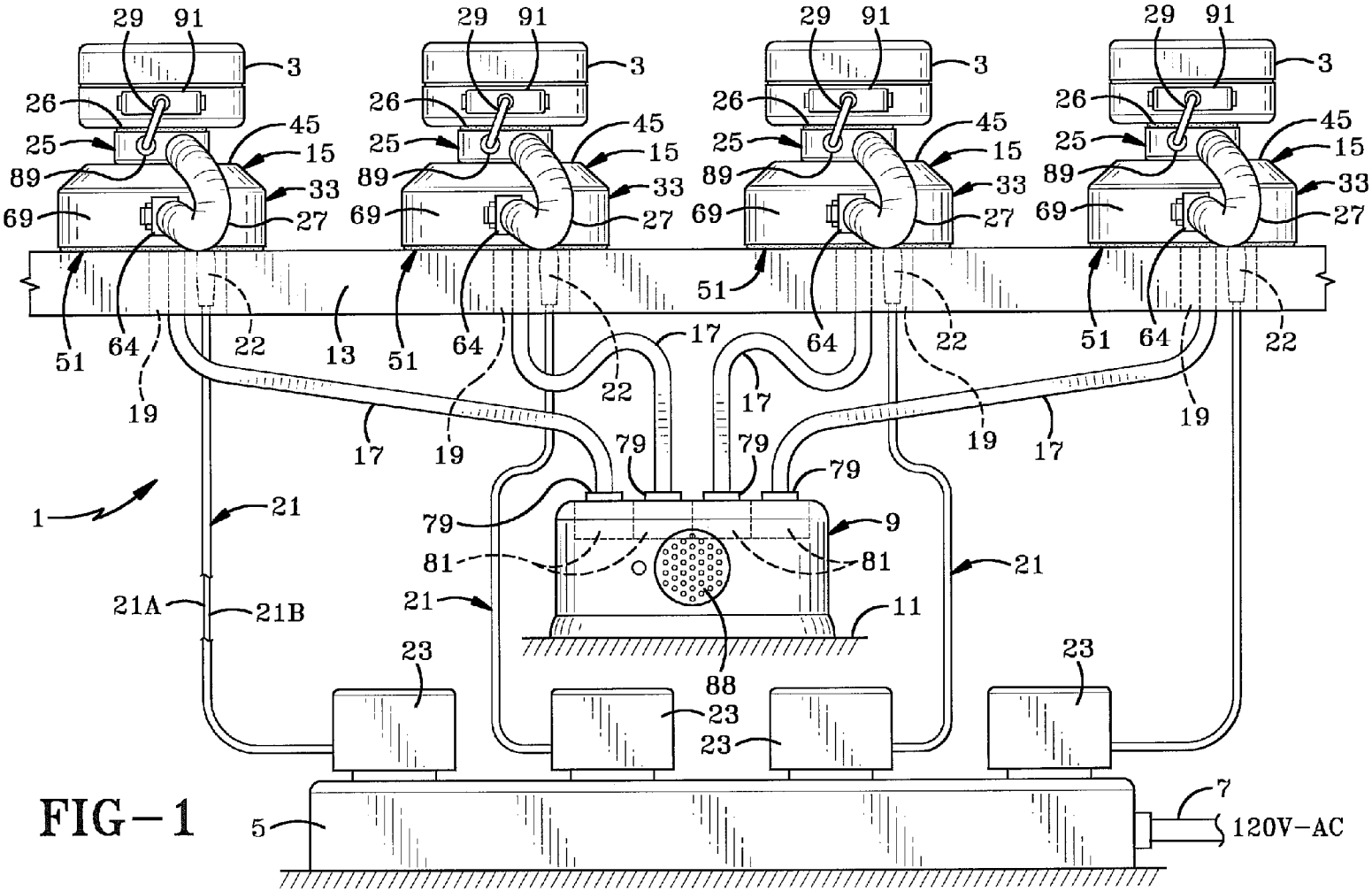
FIG. 1 is a diagrammatic perspective view of the security display of the present invention depicted with four separate items of merchandise being displayed and protected by a central alarm module of the security system.

The security display with a central control system of the present invention is indicated generally at 1, and is shown diagrammatically in FIG. 1. The system is shown displaying and protecting four items of merchandise, each of which is depicted as a cell phone 3. However, the number and types of displayed items can change without affecting the invention. One of the components of the security display and control system of the present invention includes a remote power supply 5 such as a power bus bar, which will be connected to a remote source of electricity by a power cord 7. Typically in most retail establishments, this will be 120V-AC. Another major component is a central alarm module 9 which is mounted on a support surface 11, preferably located in an inaccessible location beneath or spaced from a display shelf or support surface 13 on which is mounted a plurality of display modules 15, four of which are shown in FIG. 1. However, this could be any number of display modules, all of which could be located on a single display surface 13 or each placed at separate locations on different display shelves or surfaces without affecting the concept of the invention.

In accordance with one of the features of the invention, each of the display modules 15 is connected by a lanyard or power cord 17 to alarm module 9. Power cord 17 preferably is connected to each alarm module 15 by extending through a hole 19 formed in display surface 13 and into the interior of each of the display modules as discussed further below. Each of the display modules will also be connected to the remote source of electric power by a power cord 21. Preferably a transformer 23 is connected between power cord 21 and the source of power to convert the 120V-AC voltage to between 3V and 9V-DC voltage which is the voltage used for supplying power to many of the types of products to be displayed and protected in the security display of the present invention. However, this voltage can vary without affecting the invention. Power cords 21 also extend through holes 19 or a different hole and into the bottom of display modules 15 and preferably terminate in a plug 22 for quick and easy attachment to and from display modules 15. Also, each of the display modules 15 have a sensor 25 (FIG. 4) electrically and mechanically connected to the display module by a second power cord or lanyard 27. Each of the sensors 25 in turn is adapted to be connected mechanically and electrically to the displayed product 3 by a power cord 29 and attached to the product by various means such as a pad of pressure sensitive adhesive 26, zip ties, or other types of fasteners.

Figure 2:
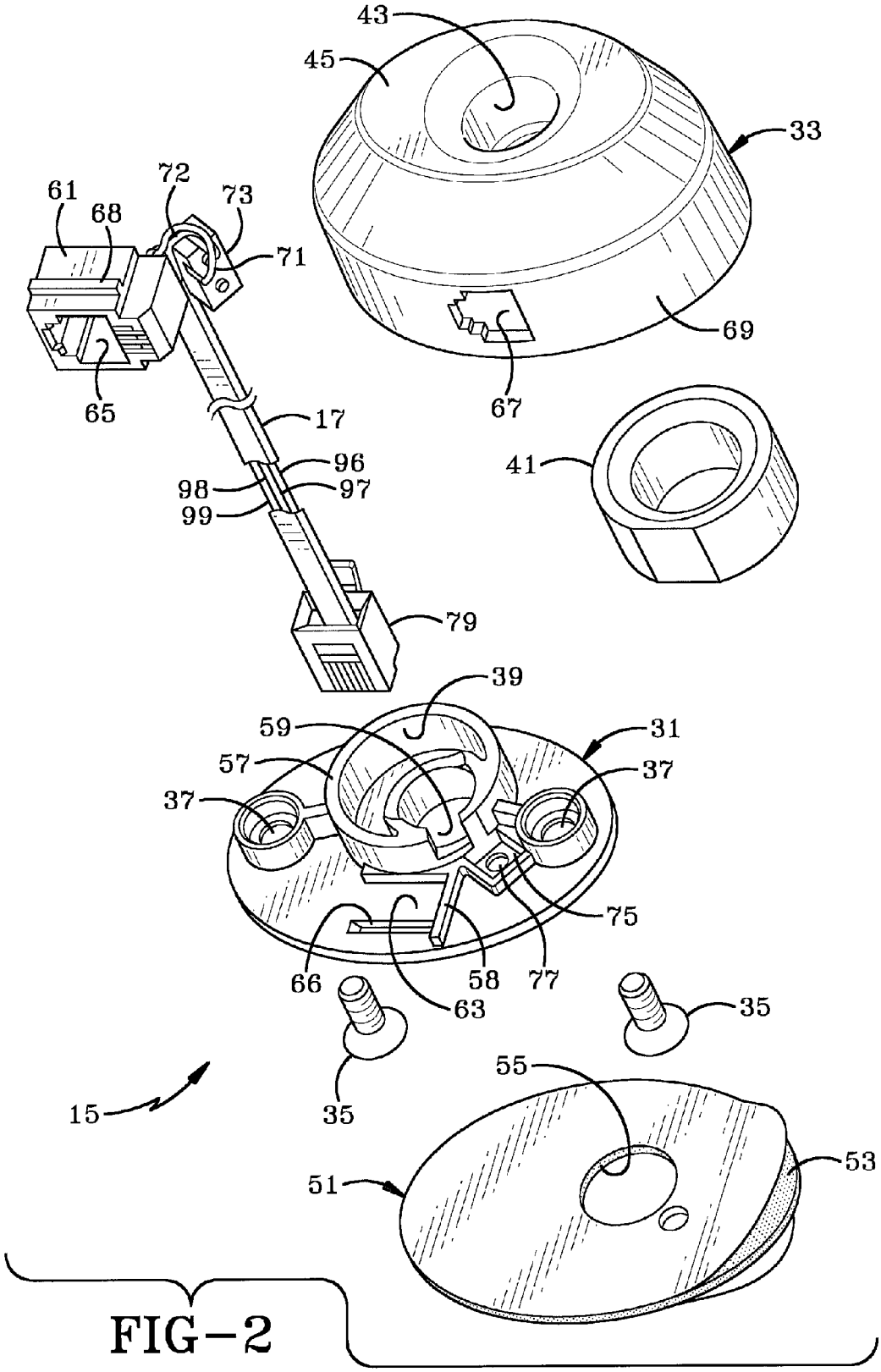
FIG. 2 is an exploded perspective view of the display module component of the security system.

FIG. 2 is an exploded perspective view of one of the display modules 15. Each of the display modules includes a main mounting base 31 and a top generally dome-shaped top cover 33 which is secured to base 31 by a plurality of fasteners 35 which extend through holes 37 formed in base 31 and into screw fastener receiving receptacles (not shown) formed in the interior of top cover 33. This forms a hollow interior, in which is located a cylindrical-shaped compartment 39 formed on base 31 which serves as a platform for placement of a ring-shaped magnet 41 thereon. Magnet 41 extends about a recessed opening 43 formed in the top surface 45 of top cover 33. Recess opening 43 provides a seat for receiving a projection 47 therein, which extends outwardly from sensor 25 (FIGS. 3 and 4) and which contains a second magnet 49. Magnets 41 and 49 provide self-alignment or self-orienting arrangement of sensor 25 on display module 15. This type of self-orienting feature is shown and described in pending patent application Ser. No. 11/507,300, filed Aug. 21, 2006, the contents of which are incorporated herein by reference. This referenced application also illustrates a mechanical self-alignment feature which could be incorporated into sensor 25 and cover 33 without affecting the concept of the present invention.

Figure 4:
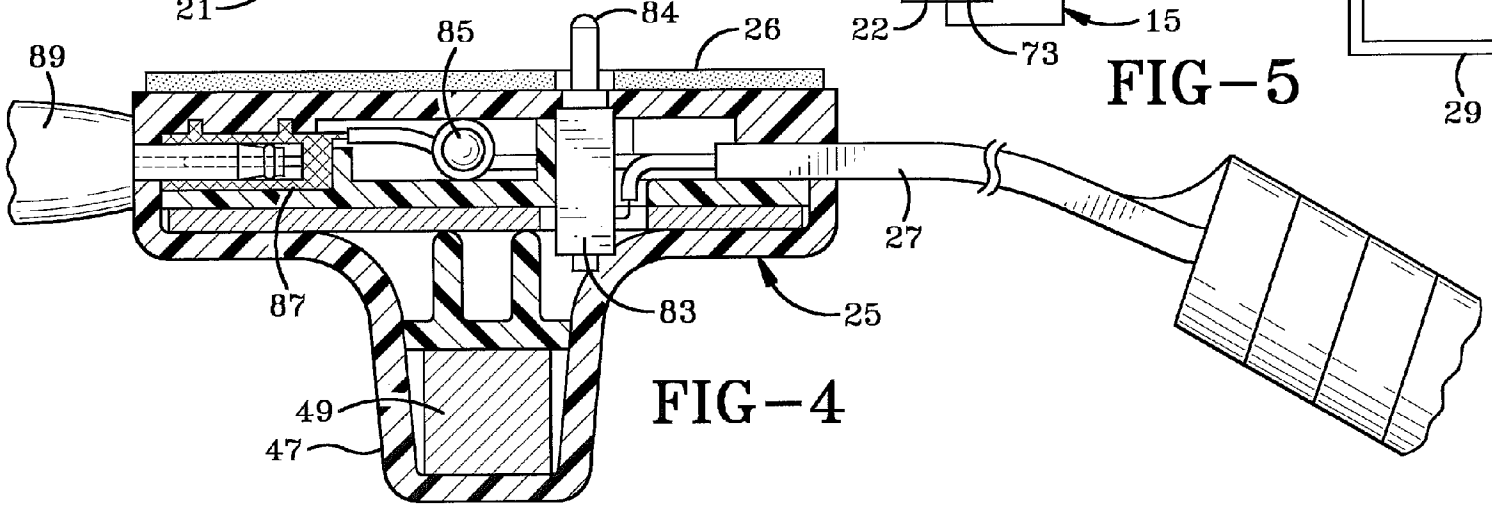
FIG. 4 is an enlarged sectional view of the sensor component of the security system.

Display module 15 preferably is intended to be mounted on support surface 13 by various types of fasteners including a pad 51 having a pressure sensitive adhesive 53 on both sides thereof (FIG. 2) for securing it to the top surface of support 13 and to the bottom of mounting base 31. Pad 51 is formed with a central opening 55 which aligns with hole 19 of support surface 13 through which power cord 17 extends. Cylindrical compartment 39 is formed by a cylindrical wall 57 which extends upwardly from mounting base 31 and is formed with a side slot 59 through which the four conductors of power cord 17 pass for mounting a power output jack 61 within an area 63 formed by an end wall 58 and a slot 66. Output jack 61 includes a pair of ribs 68, one of which is received in slot 66 to retain jack 61 in area 63. Jack 61 has a receptacle 65 that aligns with a complementary-shaped opening 67 formed in side wall 69 of top cover 33. A power input jack 73 is mounted within a rectangular compartment 75 formed on and extending upwardly from mounting base 31. Compartment 75 is formed with a central hole 77 through which power cord 21 enters display module 15 where plug 22 is releasably connected to power input jack 73. A pair of conductors 71 and 72 extend from power input jack 73 to power output jack 61 for electrically connecting jack 73 to jack 61. Thus, output jack 61 has six internal contacts for the four conductors of power cord 17 and the two conductors from power input jack 73 (FIG. 4). Power cord 17 terminates in an end terminal connector or plug 79 which is adapted to be snap-fitted into a selected port 81 provided in alarm module 9 as shown in FIG. 1. Power cord 17 preferably contains four conductors 96, 97, 98 and 99 which terminate at the opposite end from plug 79 in power output jack 61. Conductors 71 and 72 electrically connect power conductors 21A and 21B of power cord 21 to power output jack 61.

Figure 3:
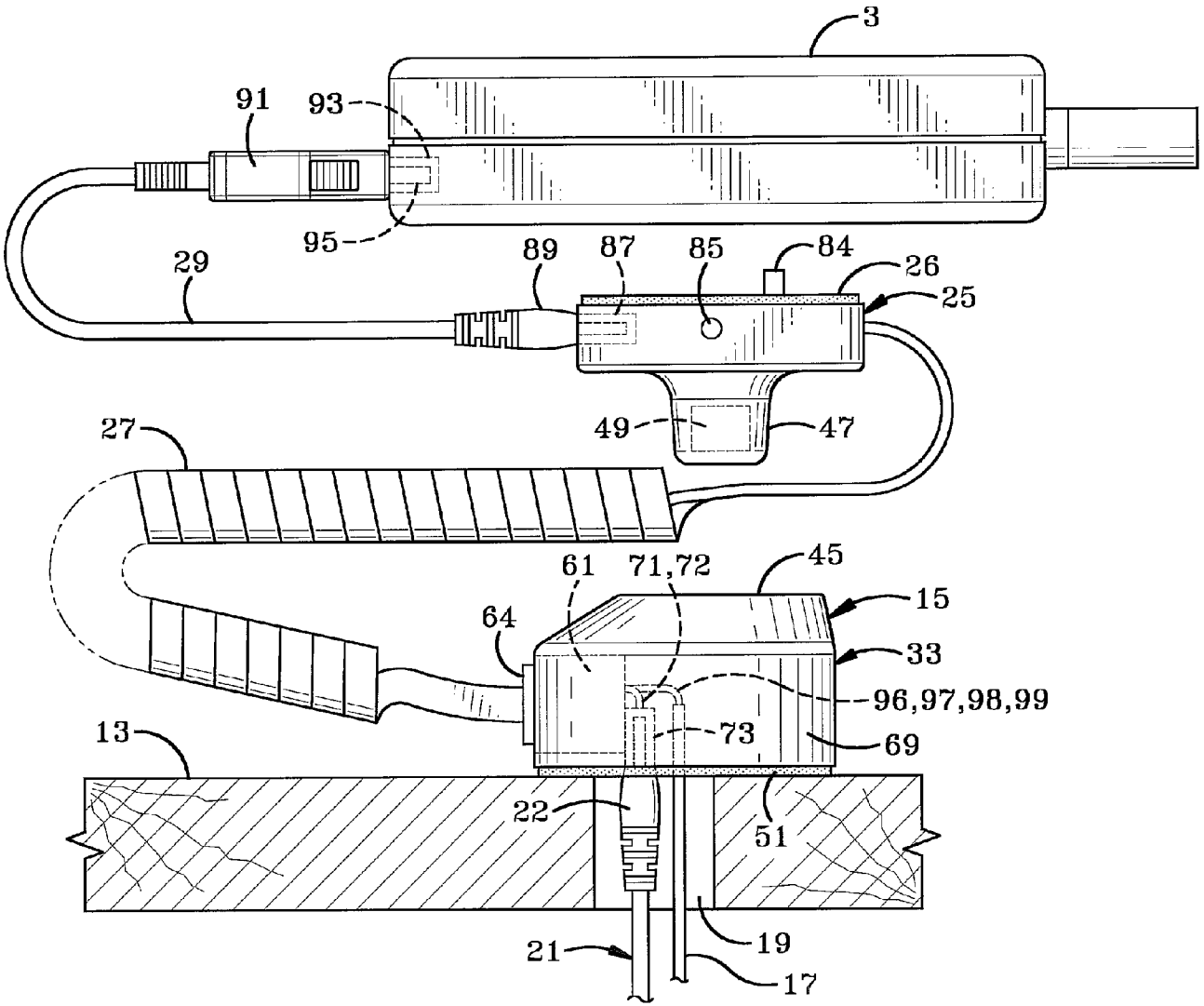
FIG. 3 is an enlarged side partially exploded view of the display module and sensor connected to an item of merchandise.

Sensor 25 is shown in FIG. 4, and in addition to magnet 49 mounted within projection 47 preferably includes a plunger switch 83 having an outwardly extending plunger 84 and a visual indicator such as an LED 85. Preferably power cord 27 is hardwired to switch 83 and LED 85 in sensor 25 as shown in FIG. 4, but could be connected by a removable plug and receptacle if desired. A power output jack 87 preferably is mounted in one end of sensor 25 and is adapted to receive a power plug 89. Plug 89 is mounted on a first end of power cord 29 which terminates in a plug 91 which is mounted on a second end of cord 29 (FIG. 3). Plug 91 is received within a receptacle 93 which is the type of receptacle provided in equipment such as cell phone 37, for charging the internal battery or connecting it to a remote source of power for operation of various components thereof. Therefore, the contacts of plug 91 illustrated at 95, are chosen to be compatible with the particular contact configuration in receptacle 93 of the displayed item 3.

In accordance with one of the main features of the invention, only one central alarm module 9 is used and will be provided with a plurality of ports 81, each of which is adapted to receive a plug 79 mounted on an end of power cord 17. Alarm module 9 is very similar to that disclosed in pending patent application Ser. No. 11/289,880, filed Nov. 30, 2005, which discloses one type of alarm system which can be incorporated therein. The contents of this referenced patent application are incorporated herein by reference with the main difference being that four separate ports are provided therein, each of which is operationally connected to the internal alarm system. Alarm module 9 preferably includes its own internal source of power such as a battery, for powering the alarm circuitry usually formed on a printed circuit board and contained within alarm module 9, but could be connected to an outside source of power if desired. Alarm module 9 will also contain an audible alarm located adjacent a speaker grille 88 (FIG. 1) which is actuated upon the integrity of power cords 27 and 29 being compromised, such as being severed by a thief, or if plug 89 is removed from sensor 25, or plug 64 being disconnected from receptacle 65 of display module 15.

Figure 5:
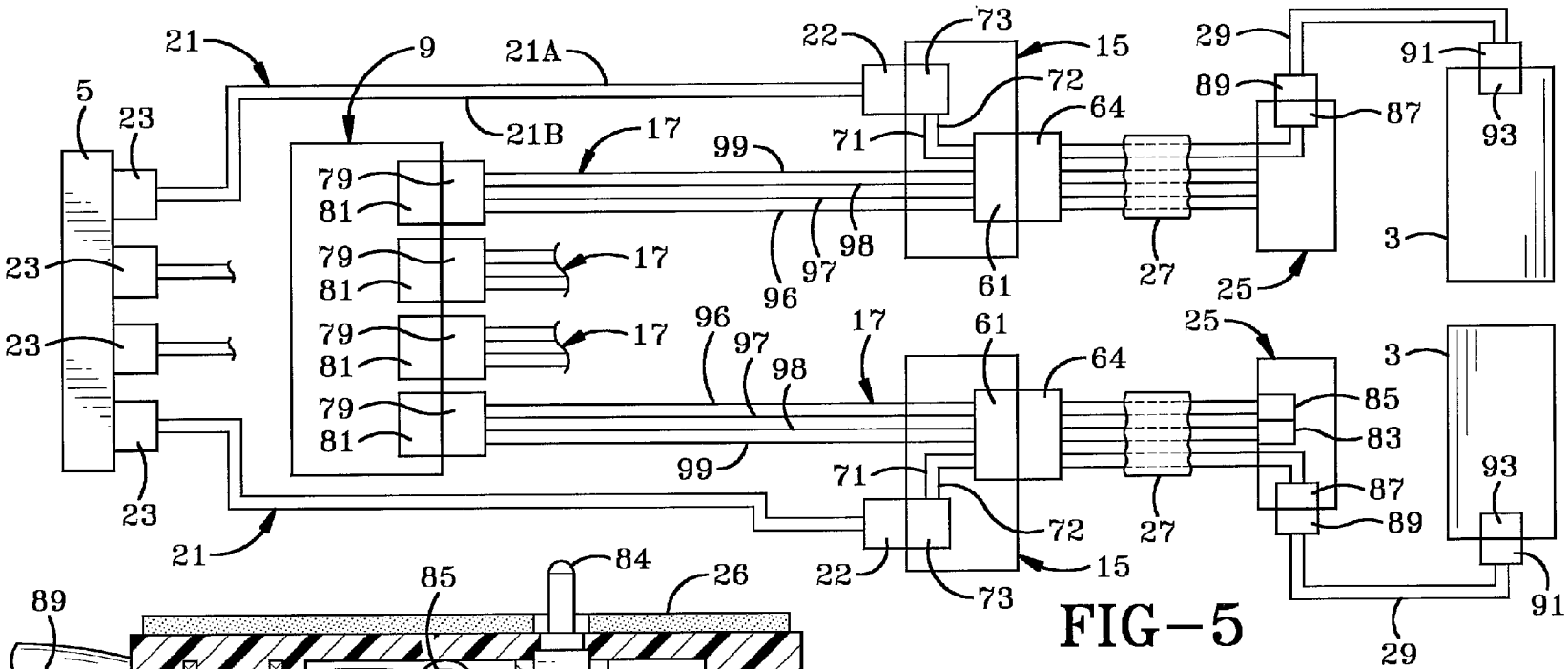
FIG. 5 is a diagrammatic schematic wiring diagram of the security display with central control of the present invention.

As shown in the diagrammatic wiring diagram of FIG. 5, the two conductor power cords 21 extend from transformer 23 and power supply 5 and connect to power input jack 73 of display module 15 which is then connected by conductors 71 and 72 to power output jack 61. Each of the power cords 17 which extend from alarm module 9, preferably contain four conductors 96, 97, 98 and 99 which connect to power output jack 61. Conductors 96 and 97 are electrically connected to selected conductors of power cord 27 to provide the power for sensor LED 85 with conductors 98 and 99 being connected to other conductors of power cord 27 to provide power to plunger switch 83. Power conductors 21A and 21B electrically continue through output jack 61 for connection to power plug 89, which conductors are subsequently connected to product 3 by plug 91 to provide the desired DC voltage to item 3.

Thus, in accordance with the invention, a single central control alarm module 9 which preferably is located at a remote inaccessible location, such as beneath the display counter, contains a plurality of connection ports 81 into which one end of power cord 17 is snap-fitted. Power cord 17 preferably has at least four conductors, and is connected to alarm module 9 and to power output jack 61 mounted within each of the display modules 15. Power cord 17 passes through a hole 19 formed in the bottom of support 13 and connects to an output jack 61. A six wire power cord 27 extends from each of the display modules 15 to a sensor 25 for powering a plunger switch 83, and if desired an LED 85. The power for operating the alarm circuitry and plunger switch 83 and LED 85 is provided by the internal battery power of alarm module 9 in the preferred embodiment. Also, in accordance with one of the main features of the invention, the electric power (voltage) is provided from power source 5 through transformer 23 and power cords 21, 27 and 29 to a plug 91. Plug 91 has contacts which are compatible with the contacts of input receptacle 93 of the product being protected for charging the internal battery or supplying electrical power to other features of the displayed equipment. It is readily understood that item 3 is protected by sensor 25 and alarm module 9 even when the electrical power is not being supplied to sensor 25 and subsequently to the display item 3. As shown in FIG. 4, power cord 27 extending from display module 15 can be hardwired into the sensor, but if desired could be replaced by a removable connection without affecting the concept of the invention.

Thus, the system of the present invention provides for the display of a plurality of items in a secure condition, each of which is mounted on a separate display module, which module is individually connected to a source of electric power by its own power cord and then connected to a central alarm system for sounding an alarm if the product is removed from the sensor, or if the power cord connecting the sensor to the display module is severed. Each of the display modules is individually connected to the central alarm module by quick connect connectors enabling the various display modules to be readily replaced with new or different display modules for displaying different products. Most importantly, each of the displayed items is removably mounted on the display module and is supplied with electric power from the remote source of electricity for maintaining the internal battery of the displayed item charged at all times, which will enable a potential customer to actually see and handle the product when it is in its activated working condition without draining the internal battery of the item. Thus, the system of the present invention provides a security display having a central alarm and power supply in order to supply power to various types of individual products which are easily connected to and removed from the central alarm and source of electric power which provides the desired theft deterrent and product power.

It is also understood that fiber optics could be used in power cords 27 between display modules 15 and sensors 25 within the concept of the invention and within the meaning of the term power cord for electrically connecting the sensor to the display module. Likewise, plunger switches 84 could be replaced with optical switches, magnetic switches using the Hall effect, or capacitance type switches within the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security system for displaying a plurality of items of merchandise comprising:

a central alarm module;

a plurality of individual display modules mounted on one or more supports;

a sensor removably mounted on each of the display modules;

a first power cord electrically and mechanically connecting the sensor to the display module;

a second power cord extending between each of the display modules and the alarm module;

a source of electric power;

a third power cord extending from the source of electric power to each of the display modules providing an electrical conductive path from the source of electric power through the display module and through the first power cord to each of the sensors; and a fourth power cord electrically connected to the source of electric power and to the central alarm module at the sensor, and extending from the sensor for electrically and mechanically connecting the item of merchandise to the sensor to supply electric power to said item of merchandise.

2. The security system defined in claim 1 wherein each of the display modules is secured to the support by a pad of pressure sensitive adhesive.

3. The security system defined in claim 1 wherein each of the sensors includes a plunger switch for engagement with the item of merchandise.

4. The security system defined in claim 1 wherein each of the sensors is provided with a visual indicator indicating that the alarm module is activated and connected to the sensor.

5. The security system defined in claim 1 wherein each of the display modules includes a first magnet and the sensor includes a second magnet providing self-alignment of the sensor on the display module.

6. The security system defined in claim 1 wherein the display module includes a base and a top cover forming an internal chamber; in which the second and third power cords extend into said chamber, with said second and third power cords being connected to an output power jack mounted on the display module.

7. The security system defined in claim 6 wherein the first power cord is releasably connected to the output power jack of the display module and hardwired to the sensor.

8. The security system defined in claim 6 wherein the third power cord is connected to a power input jack mounted in the chamber of the display module; and in which said power input jack is electrically connected to the power output jack within the chamber.

9. The security system defined in claim 8 wherein the third power cord terminates in a plug which is releasably connected to the power input jack.

10. The security system defined in claim 1 wherein the second power cord contains at least four electrical conductors and the third power cord contains at least two electrical conductors.

11. The security system defined in claim 1 wherein the electric power source supplies DC power in the range of 3 volts to 9 volts DC.

12. The security system defined in claim 1 wherein each of the sensors includes a power output jack which releasably receives a power plug attached to one end of the fourth power cord.

13. The security system defined in claim 1 wherein the support is a display counter in a retail store; in which the central alarm is in a concealed location from the display modules; and in which the second and third power cords extend through openings in the display counter for connection within said display modules.

14. The security system defined in claim 1 wherein the central alarm module includes an audible alarm which is actuated upon the integrity of the first and fourth power cords being compromised.

15. The security system defined in claim 1 wherein the first power cord is a coiled lanyard.

16. The security system defined in claim 1 wherein the third power cord is connected to the alarm module by a snap-fit connector.

* * * * *